United States Patent [19]

Manoly

[11] Patent Number: 4,465,987

[45] Date of Patent: Aug. 14, 1984

[54] RING-BAR SLOW WAVE STRUCTURE AND FABRICATION METHOD

[75] Inventor: Arthur E. Manoly, Rancho Palos Verdes, Calif.

[73] Assignee: Hughes Aircraft Company, El Segundo, Calif.

[21] Appl. No.: 415,060

[22] Filed: Sep. 7, 1982

[51] Int. Cl.[3] ..... H01J 23/27; H01P 9/02

[52] U.S. Cl. ..... 333/156; 315/3.5; 315/39.3; 333/162; 29/600

[58] Field of Search ..... 333/162, 156, 239, 242, 333/245, 248; 315/3.5, 39.3, 3.6, 4; 29/600; 330/43

[56] References Cited

U.S. PATENT DOCUMENTS

| | | | |
|---|---|---|---|
| 2,937,311 | 5/1960 | Chodorow | 315/39.3 X |
| 4,115,721 | 9/1978 | Friz | 315/3.5 |
| 4,229,676 | 10/1980 | Manoly | 315/39.3 X |

*Primary Examiner*—Marvin L. Nussbaum

*Attorney, Agent, or Firm*—John Holtrichter, Jr.; A. W. Karambelas

[57] ABSTRACT

A tubular ring-bar slow wave structure is provided. The structure includes a plurality of axially spaced, coaxially aligned, generally parallel metallic rings connected by a plurality of generally axially parallel, alternately spaced metallic bars. The structure also includes a plurality of axially spaced, coaxially aligned, generally parallel dielectric support rings, each of which has a width that is narrower than the width of a metallic ring.

11 Claims, 12 Drawing Figures

RING-BAR SLOW WAVE STRUCTURE AND FABRICATION METHOD

TECHNICAL FIELD

This invention relates to traveling wave tubes and, more particularly, to slow wave structures.

BACKGROUND OF THE INVENTION

1. Field of the Invention

In traveling wave tubes, a beam of electrons is caused to interact with a propagating electromagnetic energy wave. The interaction amplifies the electromagnetic energy wave. In order to achieve the desired interaction, a slow wave structure is used as a path of propagation for the electromagnetic energy wave. The slow wave structure, which is generally helical in arrangement, winds about the path of the electron beam. A novel slow wave structure is the subject of the present invention.

2. Description of the Prior Art

In general, slow wave structures are common in the prior art. More particularly, a slow wave structure comprises an internal helical slow wave structure, a generally tubular external wall which surrounds the helical structure, and support members which are interposed between the external wall and the helical structure. Support members are necessary as heat conduction paths and mechanical supports. For example, support rods are disclosed in U.S. Pat. No. 3,895,326, by Hinckeledy et al., U.S. Pat. No. 4,158,791, by Lien et al., and U.S. Pat. No. 4,278,914, by Harper. In addition, ceramic or dielectric material support members are disclosed in U.S. Pat. No. 3,903,449, by Scott et al., U.S. Pat. No. 4,093,892, by Vanderplaats, and U.S. Pat. No. 4,115,721, by Friz. However, slow wave structures having ceramic or dielectric material support members in the prior art are deficient in several aspects.

One deficiency in the prior art is the inability of prior art structures to have increased interaction operating efficiency.

Another deficiency in the prior art is the inability of prior art slow wave structures to have wider bandwidth.

SUMMARY OF THE INVENTION

In view of the deficiencies in the prior art, it is a purpose of the present invention to provide a slow wave structure which has increased interaction operating efficiency.

It is another purpose of the present invention to provide a slow wave structure which has wider bandwidth.

In order to accomplish the above and further purposes, the present invention provides a novel tubular ring-bar slow wave structure. The structure includes a tubular ring-bar slow wave structure which in turn includes a plurality of axially spaced, coaxially aligned, generally parallel metallic rings which are connected by a plurality of generally axially parallel, alternately spaced metallic bars. More particularly, the ring-bar slow wave structure includes a plurality of axially spaced, coaxially aligned, generally parallel dielectric support rings, each of which is positioned atop a metallic ring. The width of each dielectric support ring is narrower than the width of each metallic ring.

In addition, a novel method of fabricating the tubular ring-bar slow wave structure comprises the steps of first mounting the tubular ring-bar slow wave structure around the periphery of a cylindrical mandrel. Next, a plurality of tubular, flexible mask rings is mounted around the ring-bar structure. The mask rings are snappably transported by a spreader strip. In addition, each mask ring is aligned for mounting on adjacent metallic rings in such a fashion that a central peripheral surface of each metallic ring, which is narrower than the entire width of each metallic ring, is exposed.

Next, the spreader strip is removed to allow the plurality of mask rings to envelope the ring-bar structure, exposing the central peripheral surface of each metallic ring. Further, a dielectric material is deposited over both the exposed central peripheral surfaces of the metallic rings and the mask rings. Also, the dielectric material is ground to a predetermined radial dimension. Lastly, the mandrel is removed and then the mask rings are removed by chemical etching.

One advantage of the present invention is that the slow wave structure is capable of having increased interaction operating efficiency.

Another advantage of the present invention is that the slow wave structure is capable of having wider bandwidth.

Other purposes, features and advantages of the present invention will appear from the following detailed description of a preferred embodiment thereof, taken together with the accompanying drawings.

DETAILED DESCRIPTION OF THE INVENTION

Figure 1:
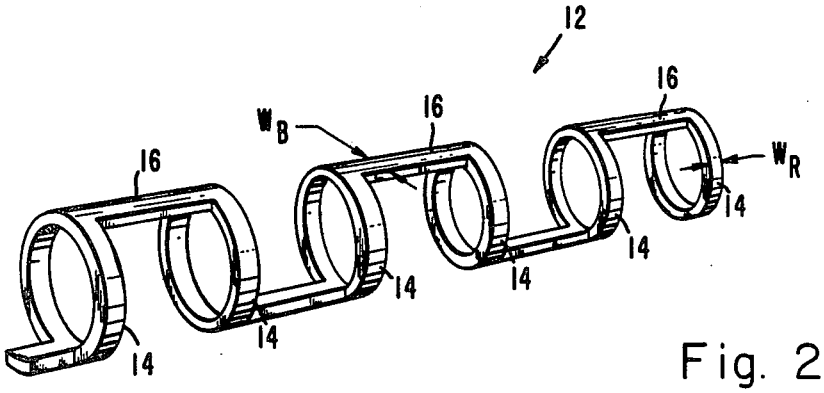
FIG. 1 is a perspective view of a ring-bar slow wave structure.
Figure 2:
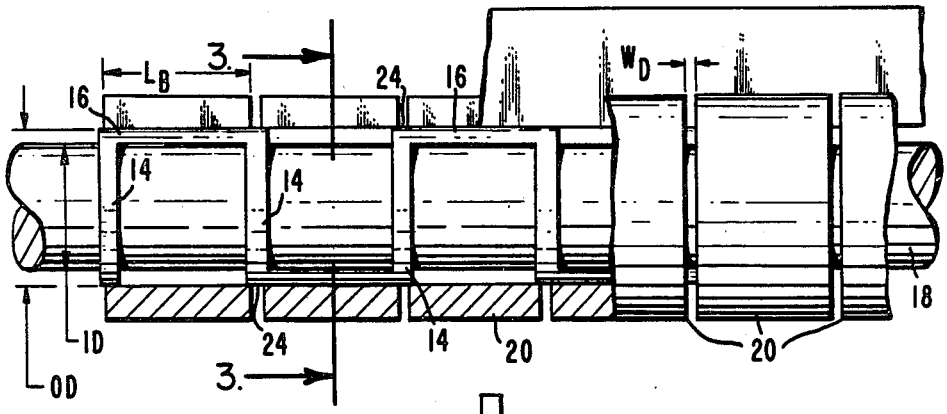
FIG. 2 illustrates a step of fabricating slow wave structures, depicting the novel method of the present invention.

Referring to FIG. 1, there is shown a tubular ring-bar slow wave structure 12. Ring-bar structure 12 comprises a plurality of axially spaced, coaxially aligned, generally parallel metallic rings 14, which are connected by a plurality of generally axially parallel, alternatively spaced metallic bars 16. Exemplary ring-bar structure 12 has an axial length of approximately 4.0 inches, an outer diameter OD of approximately 0.126 inches, and an inner diameter ID of approximately 0.095 inches, as best shown in FIG. 2. Moreover, the length of each bar 16, $L_B$, is approximately 0.120 inches. And, each of the rings 14 and bars 16 has a width, $W_R$ and $W_B$, respectively, of approximately 0.048 inches, as best shown in FIG. 1. In addition, metallic slow wave structure 12 comprises a high temperature refractory metal, such as molybdenum, tungsten and rhenium, or copper. Copper-plated molybdenum or tungsten may also be used. A ring-bar slow wave structure is the subject of the present invention.

A novel method of fabricating the ring-bar slow wave structure comprises the steps of first mounting ring-bar structure 12 around the periphery of a cylindrical mandrel 18, as best shown in FIG. 2. Mandrel 18 comprises a conventional material such as tungsten. Next, a plurality of tubular, flexible mask rings 20 is mounted around the outer periphery of ring-bar structure 12, as partially shown in FIG. 2. Mask rings 20 are snappably transported by a spreader strip 22. Each mask ring 20 is aligned for mounting on adjacent metallic rings 14 in such a fashion that a central peripheral surface 24 of each metallic ring 14, which is narrower than the entire with $W_R$ of each ring 14, is exposed. For example, the width $W_D$ of each central peripheral surface 24 is approximately 0.024 inches, as best shown in FIG. 2. In addition, mask rings 20 comprise a conventional material such as aluminum that is capable of being etched away by chemicals.

Figure 3:
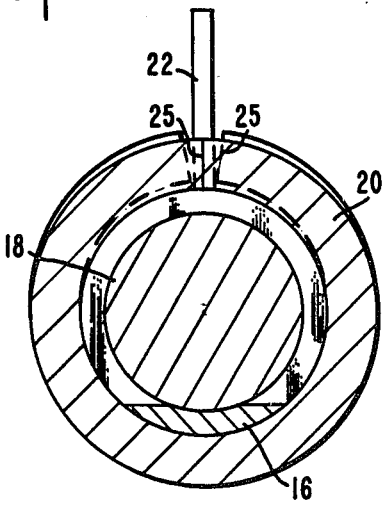
FIG. 3 is a cross-sectional view of FIG. 2, taken along line 3—3.

Next, spreader strip 22 is removed in order to allow the plurality of mask rings 20 to envelope ring-bar structure 12, exposing only the central peripheral surface 24 of each metallic ring 14. As best shown in FIG. 3, the radial surfaces 25 of mask ring 20 are shown as dotted lines when spreader strip 22 is in position and as a solid line when spreader strip 22 is removed.

Figure 4:
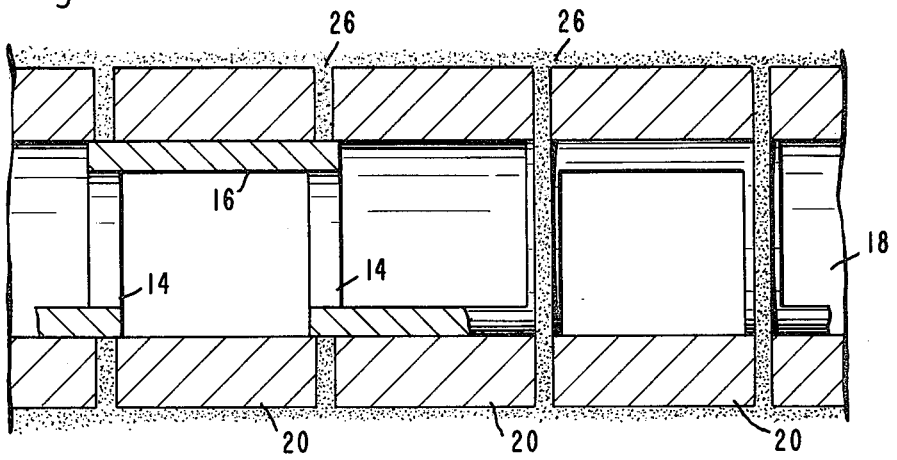
FIG. 4 illustrates a successive step of FIG. 2.
Figure 5:
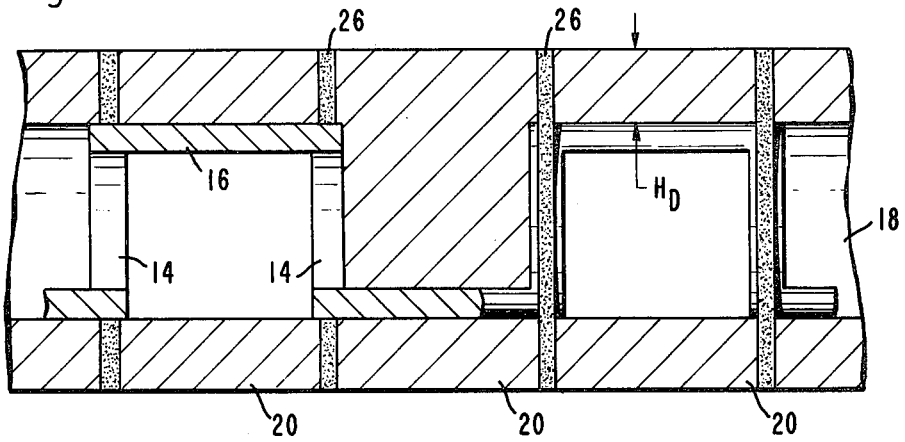
FIG. 5 illustrates a successive step of FIG. 4.
Figure 6:
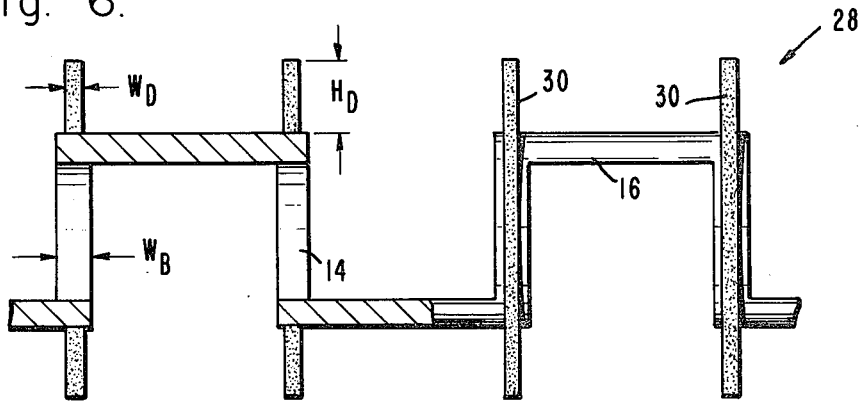
FIG. 6 is a side view, partially broken away, of a slow wave structure which has reduced width dielectric material support rings, in accordance with the present invention.

Further, a dielectric material 26 of low dielectric constant and high thermal conductivity is deposited over both the exposed central peripheral surfaces 24 of metallic rings 14 and mask rings 20, as best shown in FIG. 4. Dielectric material 26 generally comprises a ceramic such as beryllium oxide and aluminum oxide. In the example, beryllium oxide is deposited by conventional plasma spray techniques. Also, dielectric material 26 is ground to a predetermined radial dimension, as best shown in FIG. 5. In the example, the radial dimension or height, $H_D$, is approximately 0.040 inches. Lastly, mandrel 18 is removed and then mask rings 20 are removed by conventional chemical etching techniques, as best shown in FIG. 6. Conventional etching techniques generally employ etchants such as sodium hydroxide in water. The removal of mandrel 18 may be accomplished by physical removal or by conventional etching techniques.

In accordance with the present invention, the novel ring-bar slow wave structure, generally designated 28, comprises a plurality of axially spaced, coaxially aligned, generally parallel dielectric support rings 30. Each dielectric support ring 30 is positioned atop a corresponding metallic ring 14. The width $W_D$ of each dielectric support ring 30 is narrower than the width $W_R$ of each metallic ring 14. In the example, the width $W_D$ of each dielectric support ring 30 is approximately 0.024 inches and the height $H_D$ is approximately 0.040 inches.

Figure 7:
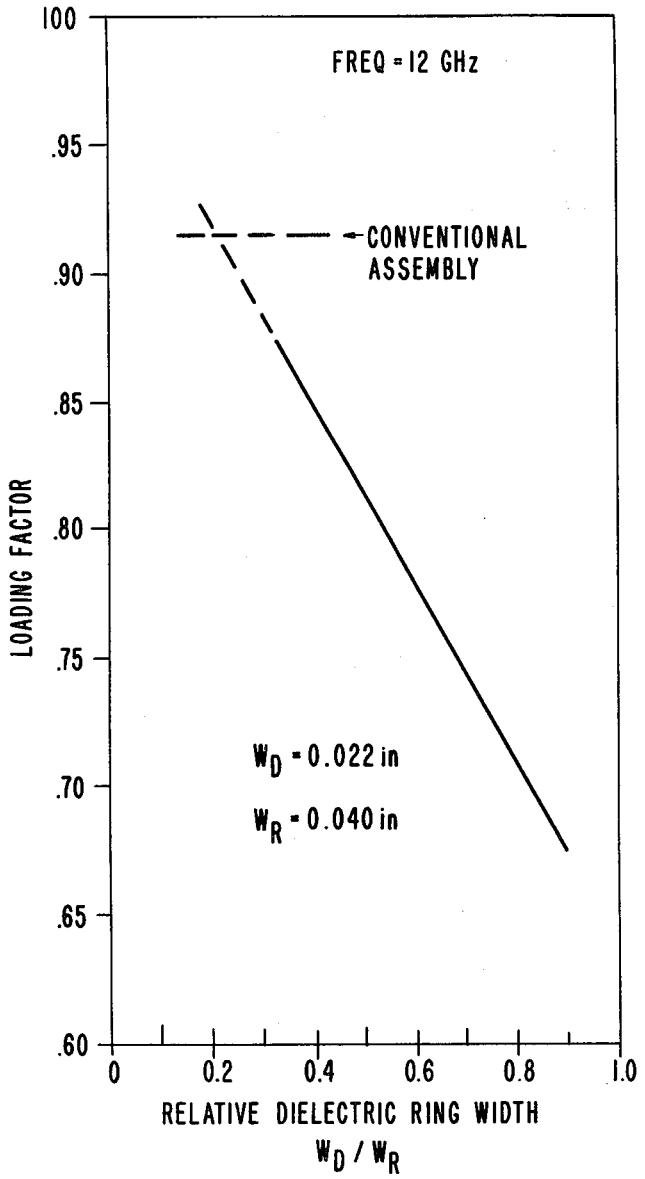
FIG. 7 is a graph illustrating the loading factor of the structure of FIG. 6.

In exemplary ring-bar slow wave structure 28, the loading factor (or the phase velocity reduction) is shown in FIG. 7. Loading factor is generally defined as a deleterious effect on the radio-frequency electromagnetic energy wave which propagates on slow wave structure 12. Whereas the loading factor for a conventional structure, that is where the widths of metallic bar 14 and dielectric rings 30 are approximately the same, is approximately 0.91, the loading factor for structure 28 decreases with increasing relative dielectric ring width. The loading factor for structure 28 ranges from approximately 0.86 to approximately 0.67. In the example, where $W_D=0.022$ inches and $W_R=0.040$ inches, the loading factor is approximately 0.80.

Figure 8:
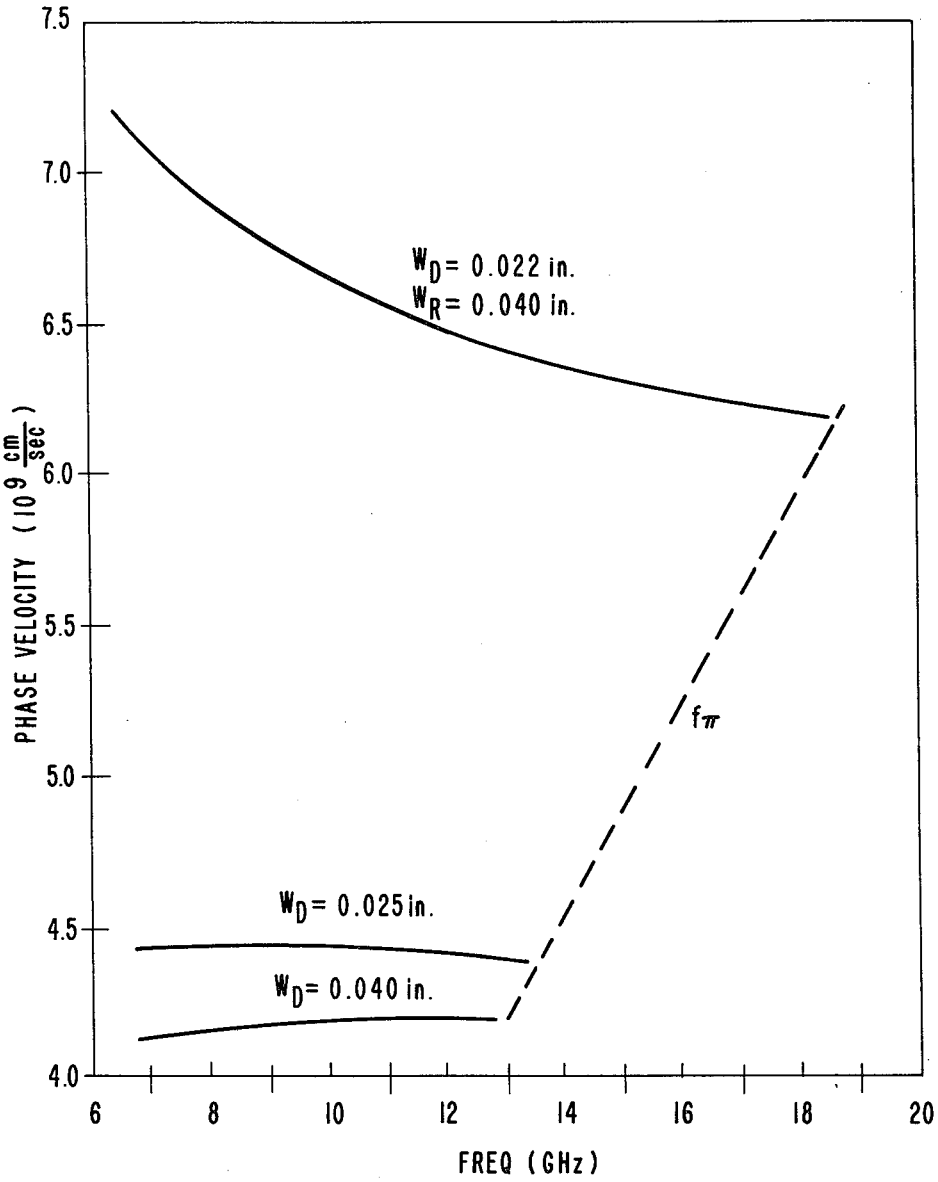
Fig. 8. (PRIOR ART)
FIG. 8 is a graph illustrating the phase velocity of the structure of FIG. 6.

In FIG. 8, a comparison of the phase velocity of prior art slow wave structures with structure 28 is shown. Phase velocity is generally defined as the speed of travel of the radio-frequency wave. In prior art structures of full width dielectric support rings, the phase velocity is in the range of 4.0 to $4.5\times10^9$ cm/sec. For structure 28, with dimensions of $W_D=0.022$ inches and $W_R=0.040$ inches, the phase velocity is in a more desirable range of 6.0 to $7.0\times10^9$ cm/sec. Moreover, the $f\pi$ or pi-point is similarly improved. Pi-point, as shown by the dotted line in FIG. 8, is generally defined as the point beyond which deleterious oscillations occur in a slow wave structure. Whereas the pi-points for prior art slow wave structures occur at approximately 13 GHz, the pi-point for structure 28 occurs at approximately 18 GHz.

Figure 9:
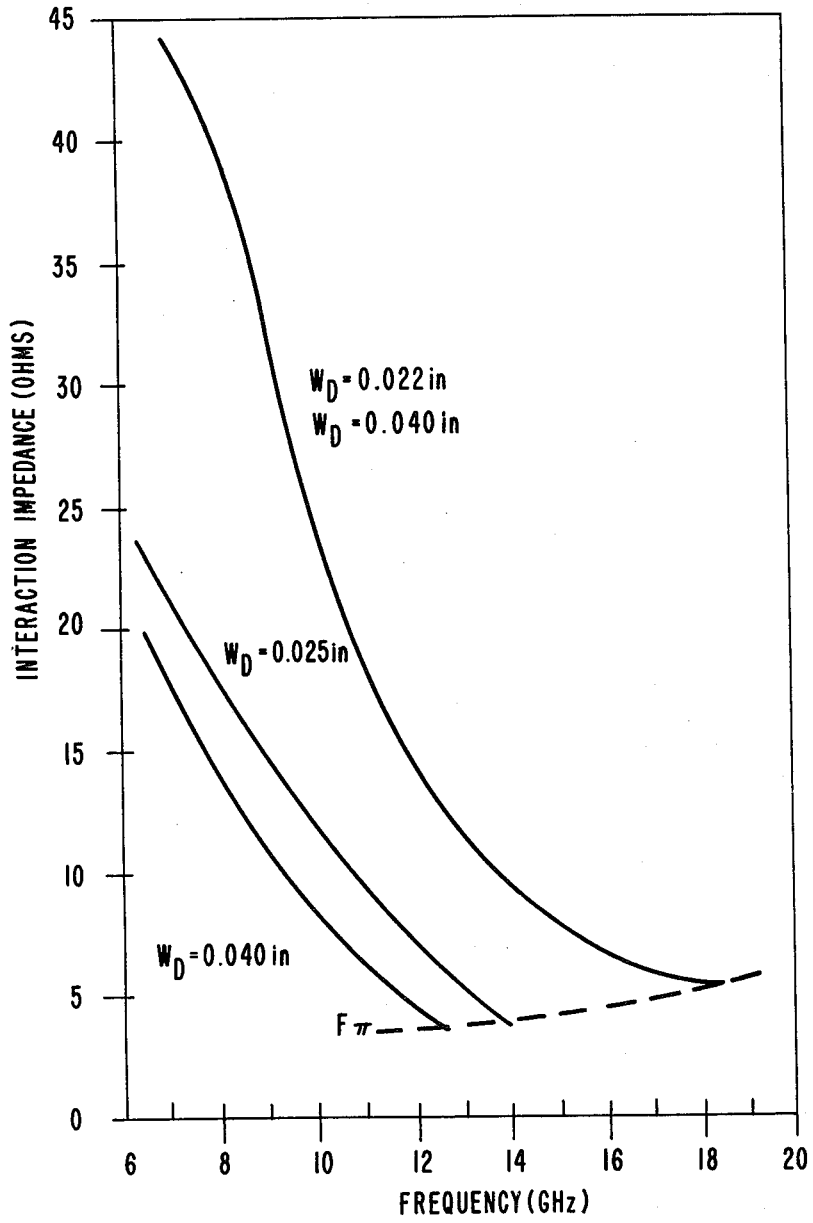
FIG. 9 is a graph illustrating the interaction impedance of the structure of FIG. 6.

Similarly, an improvement in the interaction impedance is shown in FIG. 9. Interaction impedance generally influences the efficiency of a slow wave structure. A higher interaction impedance indicates an increased generation of radio-frequency power output for a DC power input. For prior art structures which have full width dielectric support rings 30, the maximum interaction impedance is approximately 20 ohms. For structure 28, the maximum interaction impedance is approximately 45 ohms.

Lastly, the bandwidth of structure 28 is increased by approximately 20% from the bandwidth of prior art structures.

Figure 10:
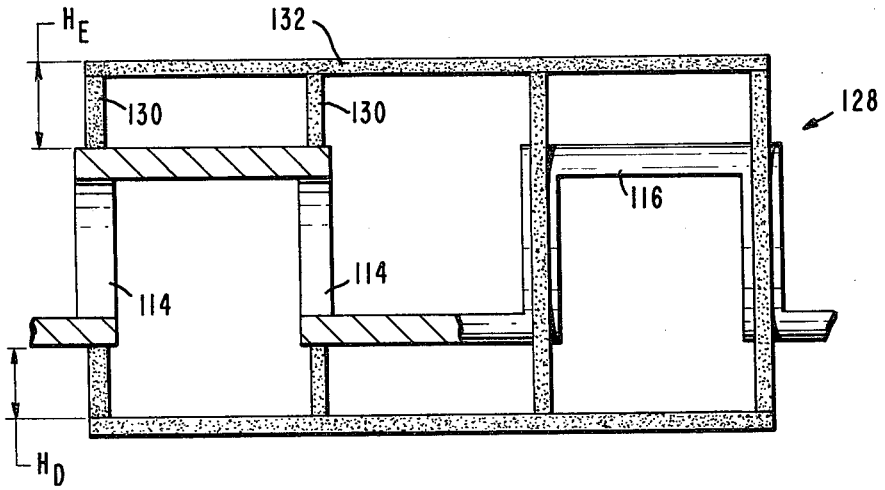
FIG. 10 illustrates a fabricating step, depicting an alternative method of FIG. 2.

Referring to FIG. 10, there is shown an alternative embodiment of structure 28. Since the components of the alternative embodiment are the same or equivalent to respective components in structure 28, a numeral "1" is added as a prefix to corresponding components of structure 28. Alternative structure 128 further comprises an outer dielectric envelope 132. Dielectric envelope 132, which comprises the same dielectric material as dielectric support rings 130, connects all support rings 130. Dielectric envelope 132 is the result of grinding the dielectric material to a radial dimension, $H_E$, which is greater than the height $H_D$ of dielectric rings 30 of structure 28. With dielectric envelope 132, the physical strength of structure 128 is improved. In addition, the bandwidth of structure 128 is increased by approximately 30% from the bandwith of prior art slow wave structures.

Figure 12:
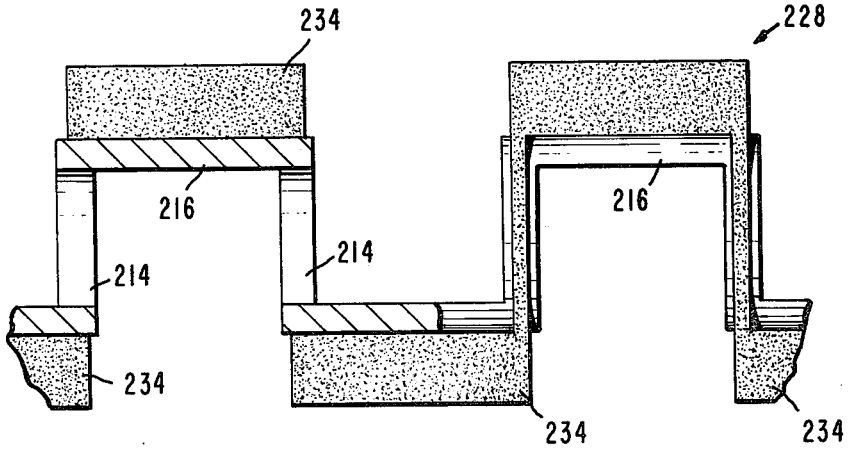
FIG. 12 is a side view, partially broken away, of another alternative embodiment of FIG. 6.
Figure 11:
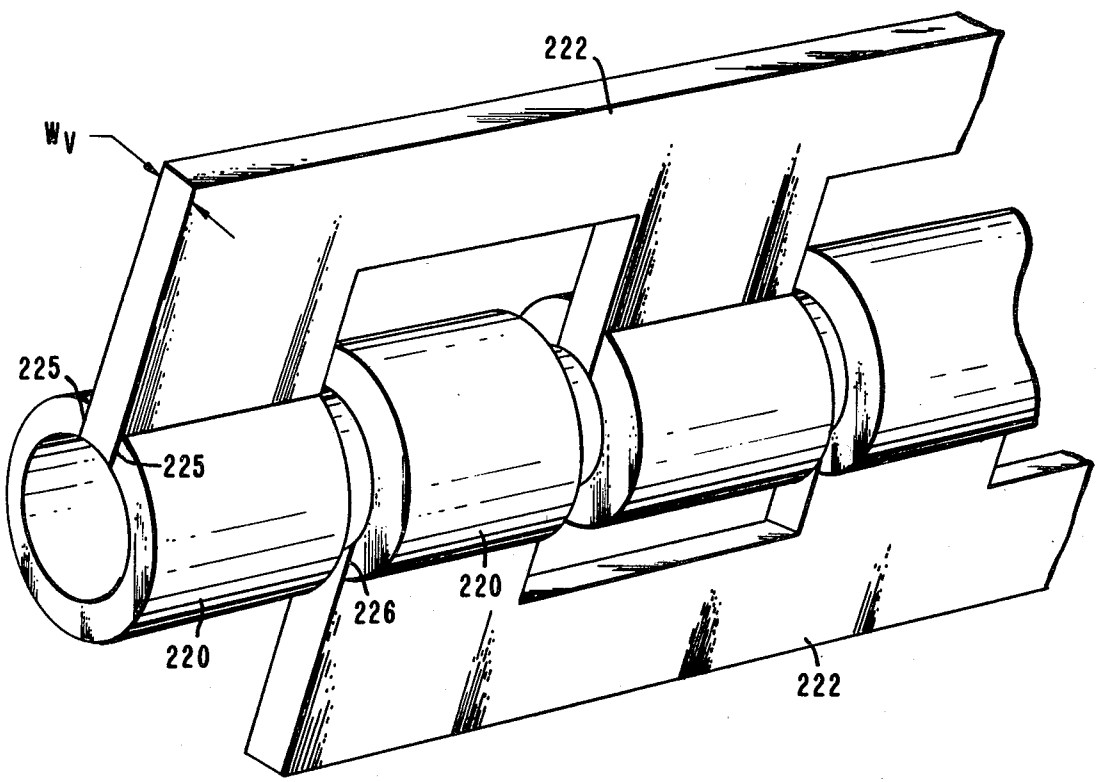
FIG. 11 is a side view, partially broken away, of an alternative embodiment of FIG. 6.

Referring to FIG. 11, there is shown a step in another alternative embodiment of the fabrication method. A numeral "2" is added as a prefix to corresponding components of structure 28. In the exemplary alternative embodiment, two spreader strips 222 are used to transport alternately spaced mask rings 220. When spreader strips 222 are removed, radial surfaces 225 of mask rings 222 do not completely close. Rather, a central peripheral surface of a metallic bar 216 is also exposed, not shown. As best shown in FIG. 12, the resultant structure 228 comprises not only dielectric material support rings 230 but also dielectric material support vanes 234. Dielectric vanes 234 are positioned atop corresponding metallic bars 216. The width $W_V$ of each vane 234, which is also generally the width of spreader strip 222, is narrower than the width $W_B$ of metallic bar 216. Having dielectric vanes 234, the thermal conductivity capability of structure 228 in conducting heat from the interior of the exterior of structure 228 is improved. Moreover, structure 228 may comprise an outer dielectric envelope, not shown, which is similar to dielectric envelope 132 of slow wave structure 128.

It will be apparent to those skilled in the art that various modifications may be made within the spirit of the invention and the scope of the appended claims. For example, the width $W_B$ of metallic bar 16 need not be the same as the width $W_R$ of metallic ring 14. Moreover, dimensions such as $H_D$, $H_E$, and $W_D$ may vary due to different applications. Or, the step of removing mandrel 18 may precede the steps of grinding dielectric material 26 and removing mask rings 20. Also, ring-bar slow wave structure 12 need not comprise alternatively spaced metallic bars 16. Rather, two or more axially extending, generally parallel metallic bars 16 may connect metallic rings 14. In such instances, spreader strips, mask rings, etc. need to be modified to produce alternative embodiments which have differently spaced and oriented dielectric vanes.

What is claimed is:

1. A tubular ring-bar slow wave structure comprising:

a tubular ring-bar slow wave structure comprising a plurality of axially spaced, coaxially aligned, generally parallel metallic rings connected by a plurality of generally axially parallel, alternately spaced metallic bars, a plurality of axially spaced, coaxially aligned, generally parallel dielectric support rings each of which being positioned atop a corresponding metallic ring, said dielectric ring having a width narrower than the width of each said metallic ring, and an outer dielectric material support envelope which connects said plurality of dielectric support rings.

2. The ring-bar slow wave structure as claimed in claim 1, further comprising:

a plurality of generally axially parallel, alternatively spaced dielectric support vanes each of which being positioned atop a corresponding metallic bar, said dielectric vane having a width narrower than the width of each said metallic bar.

3. The ring-bar slow wave structure as claimed in claim 2, further comprising:

an outer dielectric material support envelope which connects said plurality of dielectric support rings and said plurality of dielectric support vanes.

4. The ring-bar slow wave structure as claimed in claim 1, 2 or 3, wherein said metallic ring and metallic bar comprise a material selected from the group consisting of molybdenum, tungsten, rhenium and copper.

5. The ring-bar slow wave structure as claimed in claim 4, wherein said dielectric material comprises a material selected from the group consisting of beryllium oxide and aluminum oxide.

6. A method of fabricating a tubular ring bar slow wave structure, said structure comprising a tubular ring-bar slow wave structure which in turn comprising a plurality of axially spaced, coaxially aligned, generally parallel metallic rings connected by a plurality of generally axially parallel, alternately spaced metallic bars, said method comprising the steps of:

mounting said tubular ring-bar slow wave structure around the periphery of a cylindrical mandrel;

mounting a plurality of tubular, flexible mask rings around said ring-bar structure.

said plurality of mask rings being snappably transported by a spreader strip, and each of said mask rings being aligned for mounting on adjacent metallic rings, such that a central peripheral surface of each metallic ring less than the entire width of each ring is exposed;

removing said spreader strip to allow said plurality of mask rings to envelop said ring-bar stucture, exposing said central peripheral surface of each said metallic ring;

depositing a dielectric material over both said exposed central peripheral surface of said metallic rings and said plurality of mask rings;

grinding said dielectric material to a predetermined radial dimension which is greater than the radial dimension of said plurality of mask rings;

removing said mandrel; and removing said plurality of mask rings by chemical etching, whereby said ring-bar slow wave structure comprises a plurality of axially spaced, coaxially aligned, generally parallel dielectric support rings, each of which being positioned atop a corresponding metallic ring with a width narrower than said width of each of said metallic ring and whereby an outer dielectric material support envelope connects said plurality of dielectric support rings.

7. A method of fabricating a tubular ring-bar slow wave structure, said structure comprising a plurality of axially spaced, coaxially aligned, generally parallel metallic rings connected by a plurality of generally axially parallel, alternately spaced metallic bars, said method comprising the steps of:

mounting said tubular ring-bar slow wave structure around the periphery of a cylindrical mandrel;

mounting a plurality of tubular, flexible alternately directioned mask rings around said ring-bar structure, said alternately directioned masks rings being snappably transported by two spreader strips, and each of said mask rings being aligned for mounting on adjacent metallic rings, such that a central peripheral surface of both said metallic ring and said metallic bar less than the entire width of said metallic ring and said metallic bar is exposed;

removing said spreader strips to allow said plurality of mask rings to envelop said ring-bar structure, exposing said central peripheral surface of each said metallic ring and each said metallic bar;

depositing a dielectric material over both said exposed central peripheral surfaces of said metallic rings and bars and said plurality of mask rings;

grinding said dielectric material to a predetermined radial dimension;

removing said mandrel; and removing said plurality of mask rings by chemical etching, whereby said ring-bar slow wave structure comprises a plurality of axially spaced, coaxially aligned, generally parallel dielectric support rings and generally axially parallel, alternatively spaced dielectric support vanes, each of which being positioned atop a corresponding metallic ring and metallic bar with a width narrower than said width of each said metallic ring and each said metallic bar.

8. The method of fabricating a ring-bar slow wave structure as claimed in claim 7, wherein said predetermined radial dimension is greater than the radial dimension of said plurality of mask rings, whereby an outer dielectric material envelope connects said plurality of dielectric support rings and vanes.

9. The method of fabricating a ring-bar slow wave structure as claimed in claim 6, 7 or 8, wherein said metallic ring and metallic bar comprise a material selected from the group consisting of molybdenum, copper, tungsten and rhenium.

10. The method of fabricating a ring-bar slow wave structure as claimed in claim 9 wherein said dielectric material comprises a material selected form the group consisting of beryllium oxide and aluminum oxide.

11. The method of fabricating a ring-bar slow wave structure as claimed in claim 10, wherein said metallic ring and bar comprise molybdenum, said mask ring comprises aluminum, and said dielectric material comprises beryllium oxide.

* * * * *